US011535950B2

(12) United States Patent
Kao et al.

(10) Patent No.: US 11,535,950 B2
(45) Date of Patent: Dec. 27, 2022

(54) ELECTRO-PLATING AND APPARATUS FOR PERFORMING THE SAME

(71) Applicant: Taiwan Semiconductor Manufacturing Company, Ltd., Hsinchu (TW)

(72) Inventors: Chen-Yuan Kao, Zhudong Township (TW); Hung-Wen Su, Jhubei (TW); Minghsing Tsai, Chu-Pei (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 464 days.

(21) Appl. No.: 16/682,589

(22) Filed: Nov. 13, 2019

(65) Prior Publication Data

US 2020/0080221 A1 Mar. 12, 2020

Related U.S. Application Data

(63) Continuation of application No. 15/366,195, filed on Dec. 1, 2016, now Pat. No. 10,508,356, which is a continuation of application No. 13/871,712, filed on Apr. 26, 2013, now Pat. No. 9,518,334.

(60) Provisional application No. 61/776,744, filed on Mar. 11, 2013.

(51) Int. Cl.

| | |
|---|---|
| ***C25D 7/12*** | (2006.01) |
| ***C25D 17/00*** | (2006.01) |
| ***C25D 21/12*** | (2006.01) |
| ***C25D 21/10*** | (2006.01) |

(52) U.S. Cl.

CPC ..... *C25D 21/12* (2013.01); *C25D 7/123* (2013.01); *C25D 17/001* (2013.01); *C25D 17/004* (2013.01); *C25D 17/005* (2013.01); *C25D 21/10* (2013.01)

(58) Field of Classification Search

CPC ..... C25D 21/12; C25D 7/12–7/123; C25D 17/001; C25D 17/06–17/08

See application file for complete search history.

(56) References Cited

U.S. PATENT DOCUMENTS

| | | | | |
|---|---|---|---|---|
| 6,217,727 | B1 * | 4/2001 | Moore | C25D 17/001 204/225 |
| 6,251,250 | B1 * | 6/2001 | Keigler | C25D 17/001 204/224 R |
| 7,682,498 | B1 * | 3/2010 | Mayer | C25D 17/12 205/291 |
| 9,518,334 | B2 | 12/2016 | Kao et al. | |

(Continued)

FOREIGN PATENT DOCUMENTS

| | | | |
|---|---|---|---|
| JP | 08283995 | A | 10/1996 |
| JP | 2006144060 | A | 6/2006 |

*Primary Examiner* — Alexander W Keeling

(74) *Attorney, Agent, or Firm* — Slater Matsil, LLP

(57) ABSTRACT

A method of plating a metal layer on a work piece includes exposing a surface of the work piece to a plating solution, and supplying a first voltage at a negative end of a power supply source to an edge portion of the work piece. A second voltage is supplied to an inner portion of the work piece, wherein the inner portion is closer to a center of the work piece than the edge portion. A positive end of the power supply source is connected to a metal plate, wherein the metal plate and the work piece are spaced apart from each other by, and are in contact with, the plating solution.

20 Claims, 12 Drawing Sheets

(56) References Cited

U.S. PATENT DOCUMENTS

| | | | | |
|---|---|---|---|---|
| 2001/0037943 | A1 | 11/2001 | Park et al. | |
| 2004/0072423 | A1* | 4/2004 | Jorne | C25D 17/001 257/E21.585 |
| 2005/0145482 | A1* | 7/2005 | Suzuki | C25D 17/06 257/E21.175 |
| 2006/0070883 | A1* | 4/2006 | Bejan | C25D 17/007 204/225 |
| 2010/0044236 | A1 | 2/2010 | Mayer et al. | |
| 2012/0258408 | A1 | 10/2012 | Mayer et al. | |
| 2013/0062197 | A1 | 3/2013 | He et al. | |
| 2013/0292254 | A1 | 11/2013 | Kumar et al. | |

* cited by examiner

ELECTRO-PLATING AND APPARATUS FOR PERFORMING THE SAME

PRIORITY CLAIM AND CROSS-REFERENCE

This application is a continuation of U.S. patent application Ser. No. 15/366,195, filed Dec. 1, 2016, and entitled "Electro-Plating and Apparatus for Performing the Same," which is a continuation of U.S. patent application Ser. No. 13/871,712, filed Apr. 26, 2013, and entitled "Electro-Plating and Apparatus for Performing the Same," now U.S. Pat. No. 9,518,334 issued Dec. 13, 2016, which application claims the priority of the Provisional Application No. 61/776,744, filed Mar. 11, 2013, and entitled "Electro-Plating and Apparatus for Performing the Same," which applications are hereby incorporated herein by reference.

BACKGROUND

Electro-plating is a commonly used method for depositing metal and metal alloys onto semiconductor wafers. In a typical electro-plating process, the surface of a wafer is deposited with a blanket metal seed layer such as a copper seed layer. The surface of the wafer may have patterns, for example, trenches. In addition, the top surface of the wafer may also have a patterned mask layer to cover some portions of the metal seed layer, while the remaining portions of the metal seed layer are not covered. The metal is deposited on the portions of the metal seed layer that is not covered.

For performing the electro-plating, the wafer is mounted on a clamshell, which includes a plurality of electrical contacts in contact with the portions of the metal seed layer that are on the edge of the wafer. The wafer is placed into a plating solution. The metal seed layer is connected to a negative end of a DC power supply, so that the metal seed layer acts as the cathode. A metal plate, which provides the ions of the metal that is to be plated, acts as the anode, wherein the plating solution separates the anode from the cathode. When a voltage is applied between the cathode and the anode, the atoms in the metal plate are ionized and migrate into the plating solution. The ions are eventually deposited on the wafer.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments of the disclosure are discussed in detail below. It should be appreciated, however, that the embodiments provide many applicable concepts that can be embodied in a wide variety of specific contexts. The specific embodiments discussed are illustrative, and do not limit the scope of the disclosure.

An electro-plating process and the apparatus for performing the same are provided in accordance with various exemplary embodiments. The variations and the operation of the embodiments are discussed. Throughout the various views and illustrative embodiments, like reference numbers are used to designate like elements.

Figure 1:
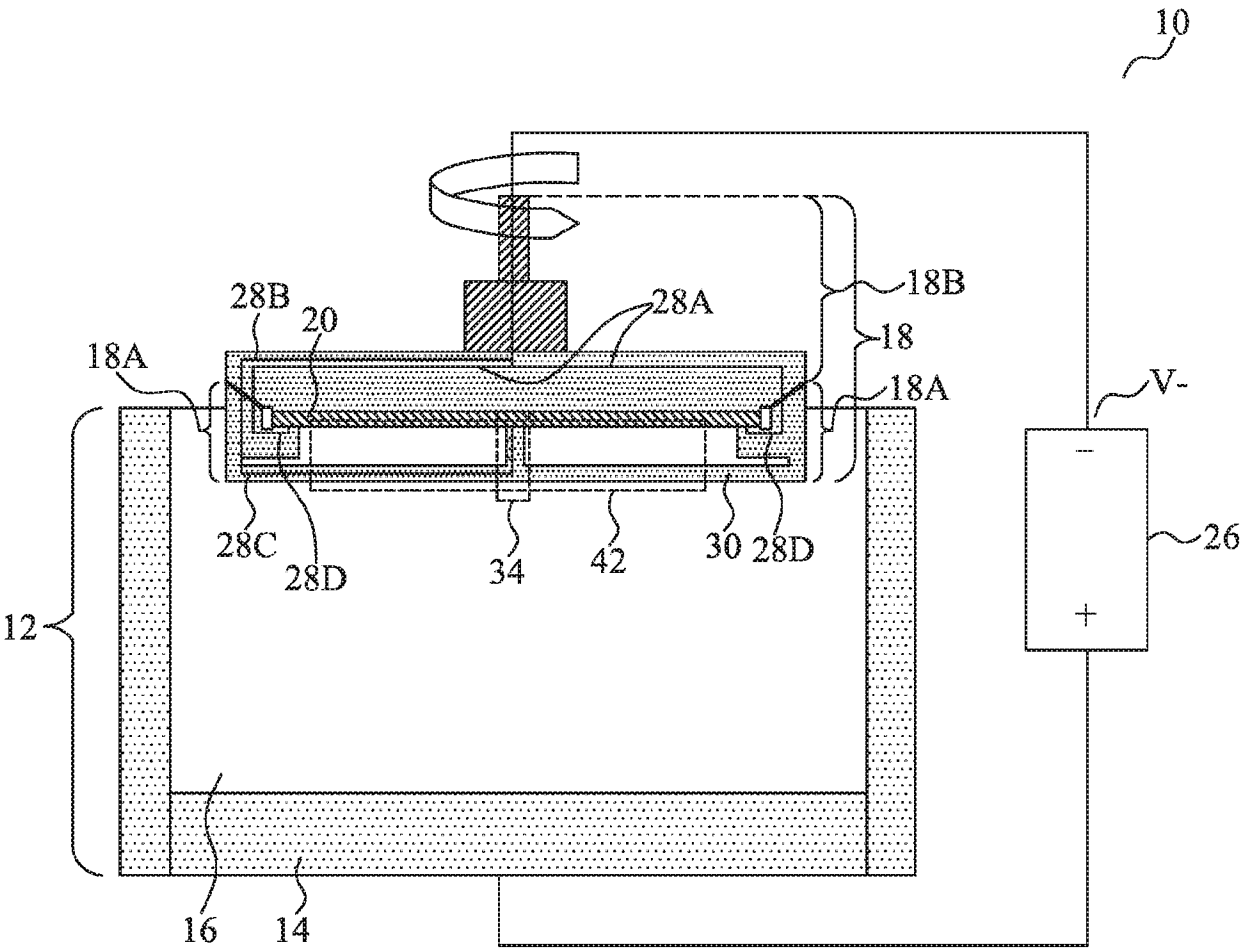
FIG. 1 illustrates a cross-sectional view of an apparatus for performing electro-plating in accordance with some exemplary embodiments.

FIG. 1 illustrates a cross-sectional view of electro-plating apparatus 10, which is used for plating a metal layer onto work piece 20. Electro-plating apparatus 10 includes electro-plating solution container 12, which holds plating solution 16. Metal plate 14 is placed at the bottom of electro-plating solution container 12. In some embodiments, metal plate 14 comprises the metal that is to be plated onto work piece 20, which metal may include copper, aluminum, tungsten, nickel, and/or the like. Plating solution 16 may include sulfuric acid, hydrochloric acid, copper sulfate, and/or or the like.

Electro-plating apparatus 10 further includes work piece holder 18, which is used to hold work piece 20. In some embodiments, work piece 20 is a semiconductor wafer, on which integrated circuits are formed. In alternative embodiments, work piece 20 may be a dielectric wafer, an interposer wafer, a substrate strip, or another type of work piece. Throughout the description, work piece 20 is referred to as a wafer, although it may also be another type of integrated circuit component. Work piece holder 18 is accordingly referred to as a wafer holder.

Figure 2:
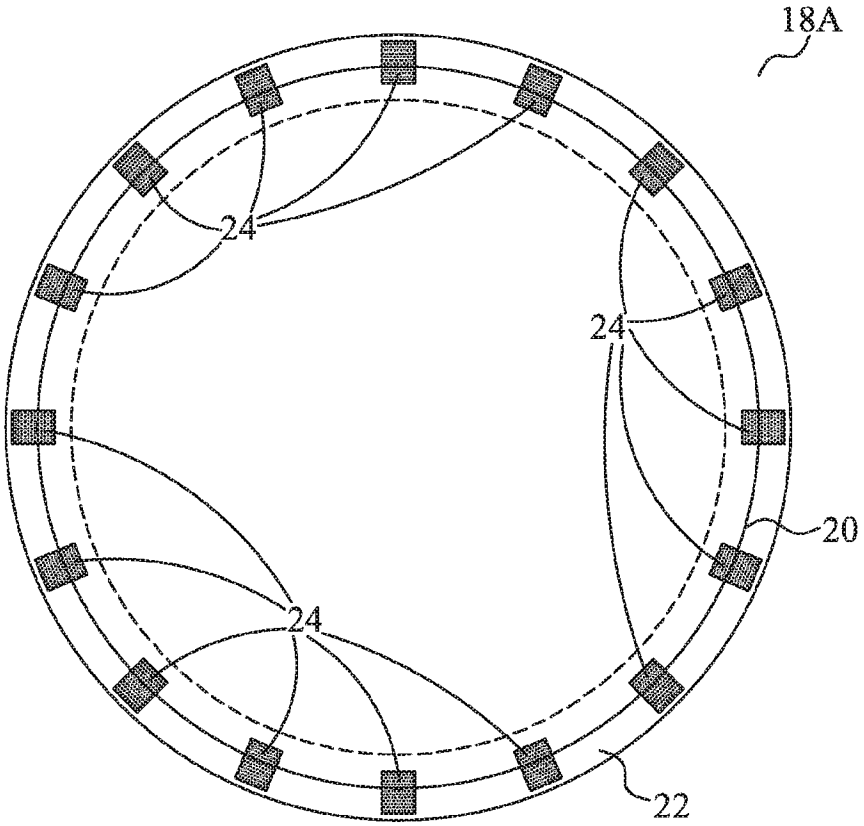
FIG. 2 illustrates a top view of a wafer and electrical contacts contacting an edge portion of the wafer.

Wafer holder 18 includes bottom piece 18A, which include lip-seal 22 and electrical contact 24 as shown in FIG. 2. FIG. 2 illustrates a top view of bottom piece 18A and wafer 20. Lip-seal 22 forms a full circle. A plurality of electrical contacts 24 are distributed at the edges of lip-seal 22, and are aligned to a circle. The plurality of electrical contacts 24 may be distributed evenly along the circle. Wafer 20 is placed on lip-seal 22 and electrical contact 24. The edge portion of wafer 20, which edge portion forms a full ring, is in contact with a bottom surface of lip-seal 22 and electrical contacts 24. Lip-seal 22 includes a relatively soft material such as rubber, so that when wafer 20 is pressed against lip-seal 22 by the top piece 18B (FIG. 1) of wafer holder 18, wafer 20 and lip-seal 22 do not have gaps in between, and plating solution 16 (FIG. 1) is confined below wafer 20, as shown in FIG. 1.

Referring back to FIG. 1, top piece 18B of wafer holder 18 includes electrical connection lines 28A and 28B embedded therein. Connection lines 28A and 28B are electrically coupled to the negative end (the cathode) of power supply source 26, which may be a DC power source. Metal plate 14 is electrically coupled to the positive end (the anode) of power supply source 26. Furthermore, bottom piece 18A also includes electrical connection line 28C, which is electrically connected to electrical connection line 28B when top piece 18B is assembled with bottom piece 18A in order to hold wafer 20 therein. Electrical connection lines 28A are electrically connected to electrical connection lines 28D, which are electrically connected to electrical contacts 24 in FIG. 2. Hence, voltage V− at the negative end of power supply source 26 is supplied to the bottom edge of wafer 20.

In some embodiments, blade 30 is built as a part of bottom piece 18A, and is mounted under wafer 20. Blade 30 may be formed as an integrated component of bottom piece 18A. Electrical connection line 28C may be embedded in blade 30. Through blade 30, electrical connection line 28C is connected to a center portion of wafer 20, and hence voltage V− at the negative end of power supply source 26 is provided to the center portion of wafer 20. During the plating, seed layer 46 (FIG. 6) may be formed at the bottom surface of wafer 20, and hence voltage V− of power supply source 26 is supplied to seed layer 46.

As shown in FIG. 1, during the plating of wafer 20, wafer holder 18 is rotated. Wafer 20, which has been fixed to wafer holder 18, is also rotated along with wafer holder 18. The atoms in metal plate 14 are ionized (and become ions) and migrate into electro-plating solution 16. The metal ions are deposited on seed layer 46 (FIG. 6) of wafer 20. With the rotation of wafer holder 18, the deposition is more uniform.

Figure 3:
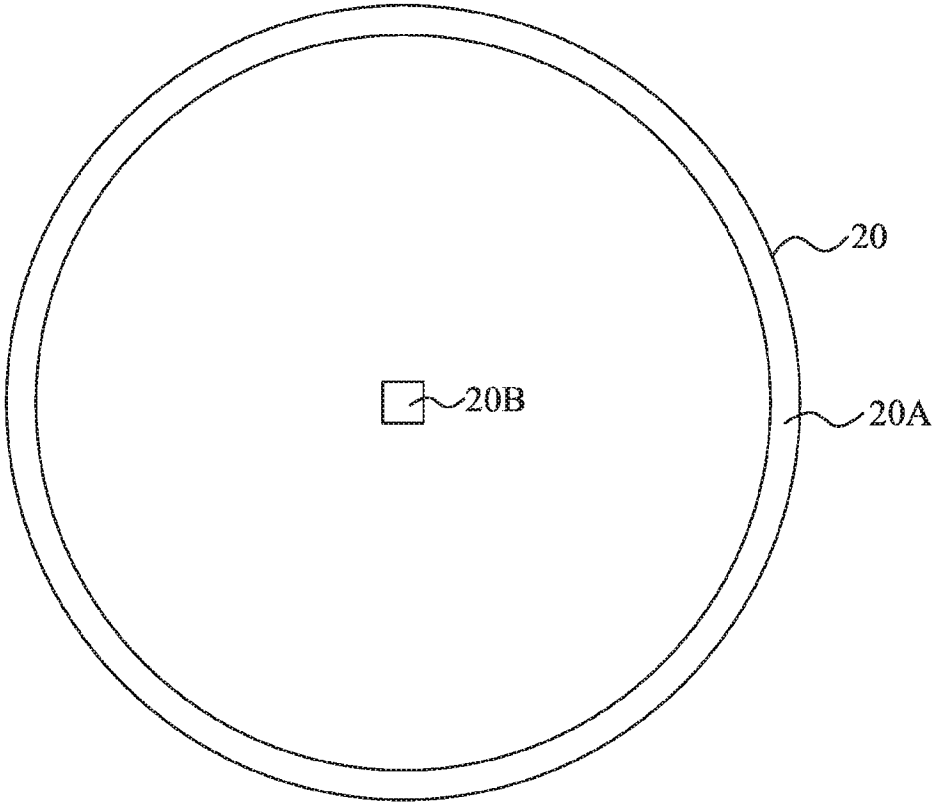
FIG. 3 illustrates a bottom view of a wafer and the portions of the wafer that are connected to electrical contacts in accordance with some embodiments.

FIG. 3 illustrates a bottom view of wafer 20 and portions of wafer 20 that are connected to electrical contacts. Wafer 20 has bottom edge portion 20A, which faces down (as in FIG. 1) and are in contact with electrical contacts 24 in FIG. 2. Furthermore, wafer 20 has bottom center region 20B, which faces down (as in FIG. 1) and are electrically connected to electrical connection line 28C in FIG. 1. Accordingly, the voltage V− at the negative end of power supply source 26 (FIG. 1) is connected to both the edge portion 20A and center portion 20B. During the plating process, the deposition rates on different portions of wafer 20 are affected by the voltages on the respective portions of wafer 20. If voltage V− is connected to wafer 20 only at the edge portions 20A of wafer 20, since metal seed layer 46 (FIG. 6) has a resistance between edge portion 20A and other portions of wafer 20, there are voltage drops between edge portion 20A and other portions. The voltages at portions 20A and other portions (such as portion 20B) are hence different from each other, resulting in different deposition rates on wafer 20. In the embodiments of the present disclosure, with voltage V− also provided to center portion 20B in addition to edge portion 20A, the voltage across the entire wafer 20 is more uniform than if voltage V− is provided only to edge portion 20A, and the deposition rates across wafer 20 are more uniform.

Figure 4:
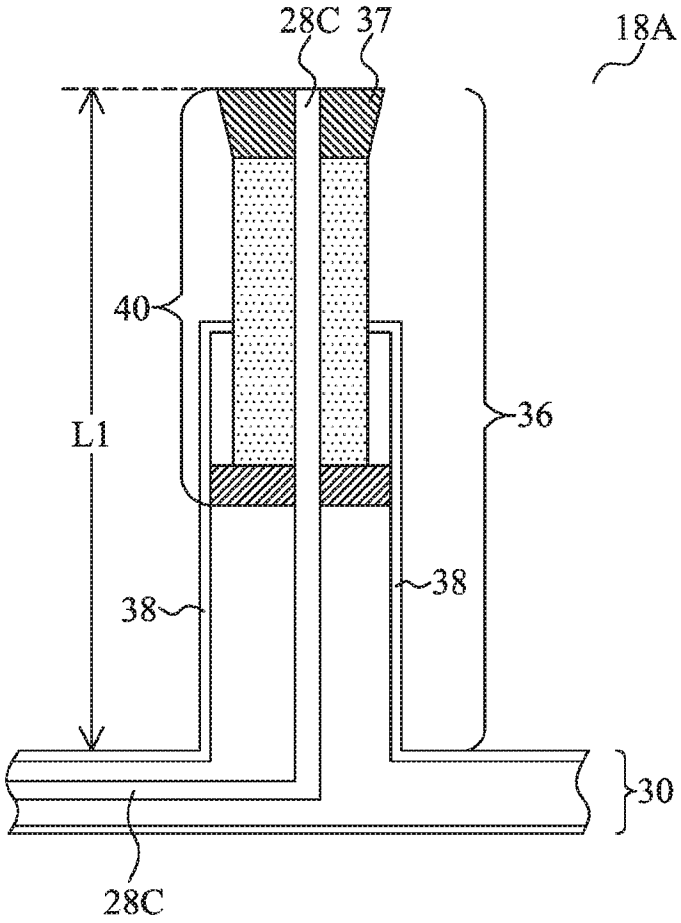
FIG. 4 illustrates a magnified portion of a portion of a bottom piece of a wafer holder in accordance with some embodiments.

FIG. 4 illustrates a magnified portion of bottom piece 18A of wafer holder 18 in FIG. 1, wherein the magnified portion is portion 34 in FIG. 1. As shown in FIG. 4, bottom piece 18A includes blade 30, and retractable electrode 36 fixed onto blade 30. Retractable electrode 36 includes outer shell 38, which is fixed onto blade 30, and cylinder 40, which is movable in outer shell 38. When cylinder 40 moves up and down in outer shell 38, the length L1 of retractable electrode 36 changes, so that connection line 28C, which is also an electrical contact (electrode), is in contact with (the seed layer of) wafer 20 (FIG. 1). The movement of cylinder 40 may be enabled through air pressure, a motor (not shown), or the like.

Retractable electrode 36 also includes seal ring 37 penetrated through by electrical contact 28C. The top end of electrical contact 28C and seal ring 37 are substantially co-planar, so that both electrical contact 28C and seal ring 37 may be in physical contact with the surface of wafer 20 at the same time. Seal ring 37 may be formed of a flexible material such as rubber in some embodiments.

Figure 5:
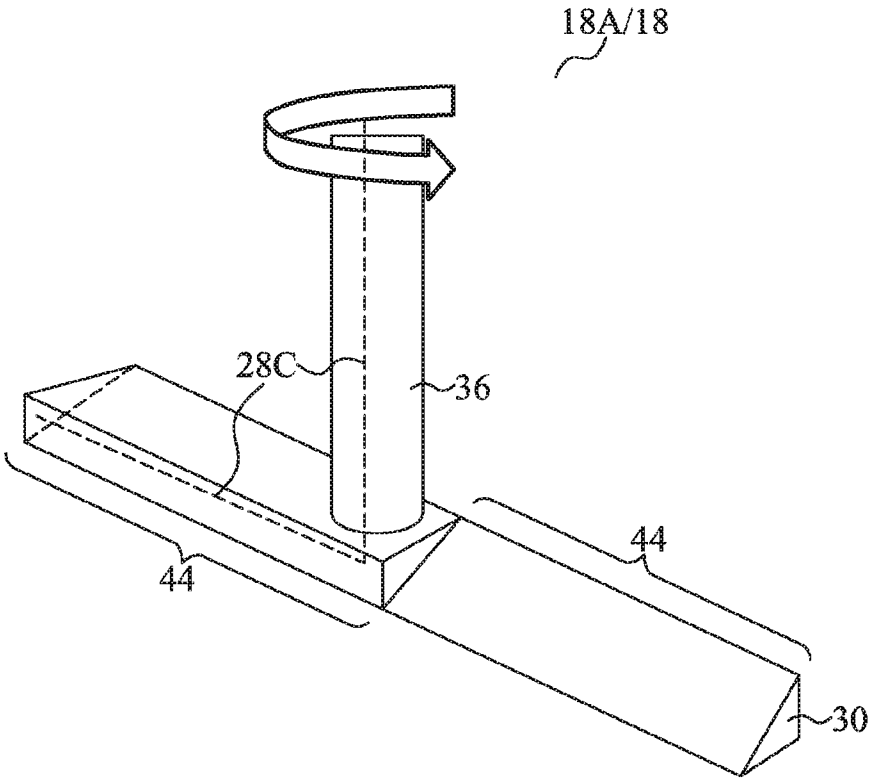
FIG. 5 illustrates a perspective view of a blade, which is a portion of the bottom piece of the wafer holder.

FIG. 5 illustrates a perspective view of blade 30, wherein the illustrated structure is a magnified view of portion 42 in FIG. 1. In some embodiments, blade 30 includes wings 44, wherein the shape of wings 44 are specifically designed. When wafer holder 18 rotates, blade 30 (which is an integrated part of the bottom piece 18A of wafer holder 18) rotates accordingly. Blade 30 hence stirs plating solution 16 (FIG. 1), so that the concentrations of the ingredients in electro-plating solution 16 (FIG. 1) are more uniform. Hence, blade 30 has the function of the fluid field control.

Figure 6:
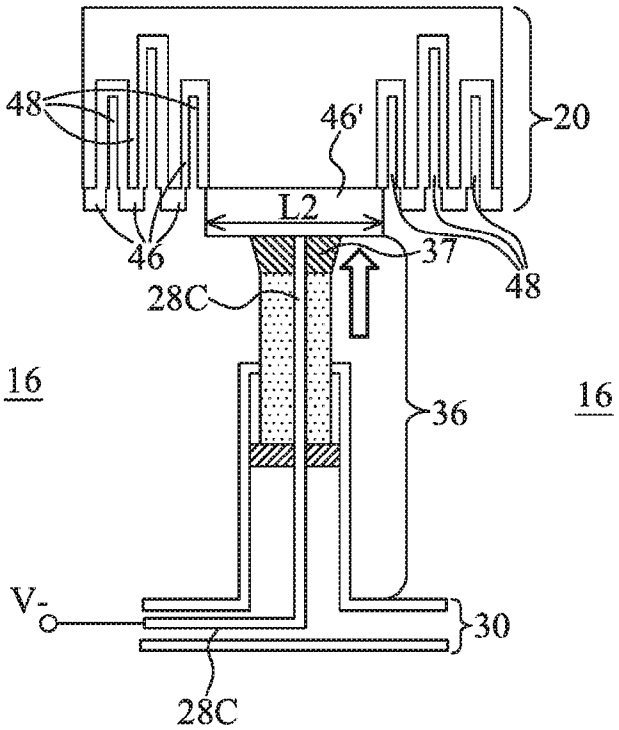
FIG. 6 illustrates how a portion of the metal seed layer that is in contact with an electrode.

FIG. 6 illustrates how electrical connection line 28C is connected to seed layer 46 of wafer 20. In accordance with some embodiments, seed layer 46, which may a metal seed layer comprising copper, aluminum, nickel, tungsten, or the like, is deposited on wafer 20 through, for example, Physical Vapor Deposition (PVD). The surface of wafer 20 may be, or may not be, planar, depending on the respective plating process and the features to be formed by the plating process. For example, FIG. 6 illustrates that wafer 20 include trenches 48, and seed layer 46 extends into trenches 48. Seed layer 46 is deposited as a blanket layer covering the entire bottom surface of wafer 20. As a result, when voltage V− of power supply source 26 (FIG. 1) is applied to the edge portion and the center portion of seed layer 46, the entire seed layer 46 is biased by voltage V−. The voltages on different portions of seed layer 46, however, may be different from each other due to the resistance of seed layer 46. This results in the non-uniformity of the deposition rates. For example, if voltage V− is applied only to the edge portions of seed layer 46, then the plating rate at the edge portions is higher than the portions encircled by the edge portions. With the increasing down-scaling of integrated circuits, the thickness of seed layer 46 becomes increasingly smaller, and the resistance of seed layer 46 becomes increasingly greater. Hence, voltage V−, when applied to the center portion 20B and edge portion 20A (FIG. 3) of wafer 20 simultaneously, the voltage difference on different portions of seed layer 46 may be reduced.

Figure 7:
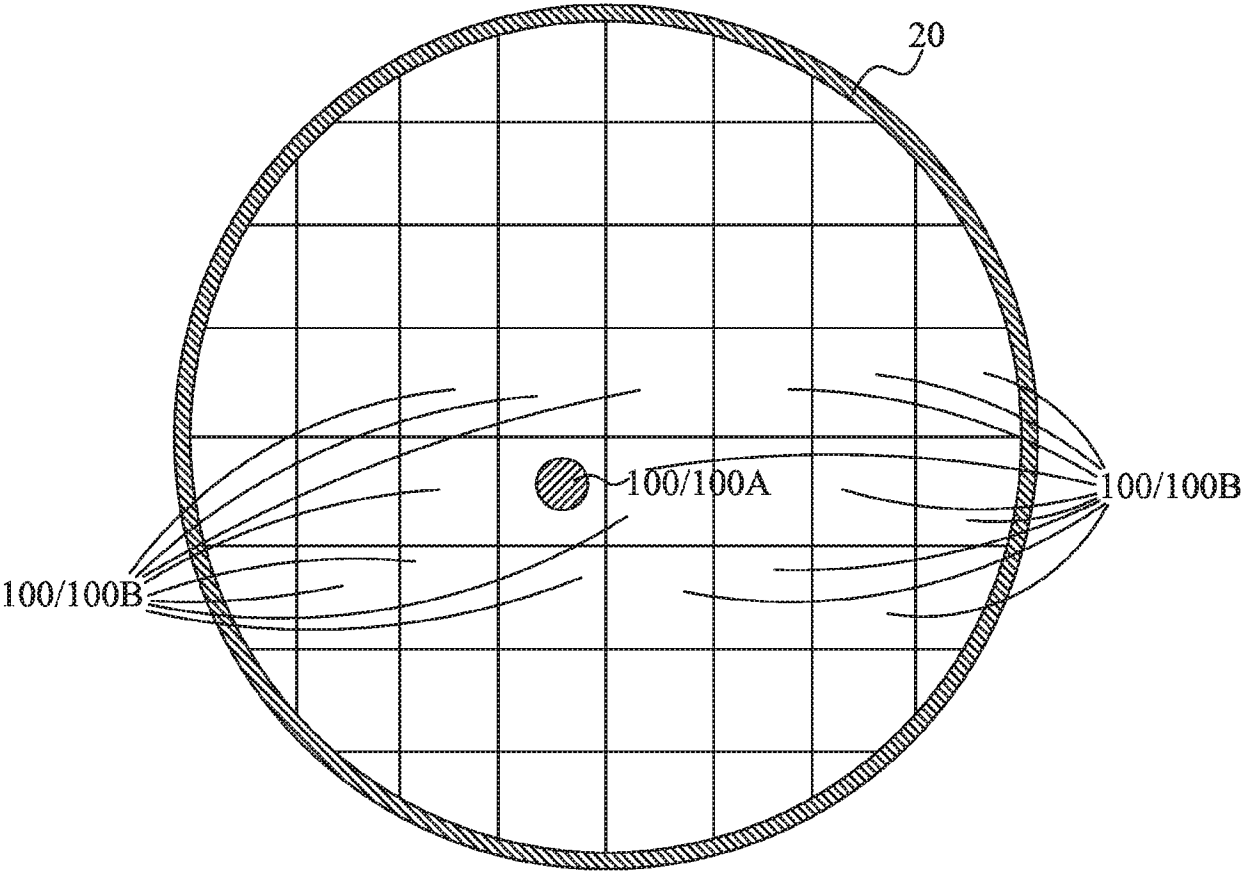
FIG. 7 illustrates that a die of a wafer is used for the electrode to connect to the metal seed layer.

Referring again to FIG. 6, in some embodiments, in order for electrical contact 28C to be in good contact with seed layer 46, and for seal ring 37 to seal plating solution 16 from reaching electrical contact 28C, seed layer 46 is designed to have a planar surface at least as large as seal ring 37, or slightly larger. In some embodiments, seed layer pad 46' has lateral dimension L2 greater than about 10 mm. It is appreciated that a typical wafer may not have such a large metal pad. In accordance with some embodiments, a chip in wafer 20 may be dedicated to the formation of seed layer pad 46'. For example, FIG. 7 illustrates an exemplary top view of wafer 20, which includes a plurality of chips 100 (including chip 100A and chips 100B). Chip 100A is dedicated to the formation of large metal pad seed layer pad 46' (FIG. 6), and hence the pattern of seed layer 46 in chip 100A is different from the pattern of seed layer 46 in chips 100B. Alternatively stated, chips 100B are identical to each other, and have structures different from that of chip 100A. In some embodiments, an entirety of or a major portion of chip 100A is used for forming a large seed layer pad 46', which has the size substantially the same as the size of chip 100A.

Referring back to FIG. 6, before a plating process is started, retractable electrode 36 is pushed toward wafer 20, so that electrical contact 28C is in physical and electrical contact with seed layer pad 46'. Seal ring 37 seals electrical contact 28C, so that plating solution 16 is not in contact with electrical contact 28C, and no metal will be plated on electrical contact 28C. Through the contact scheme in FIG. 6, a good contact may be established to supply voltage V− to seed layer 46.

Figure 8:
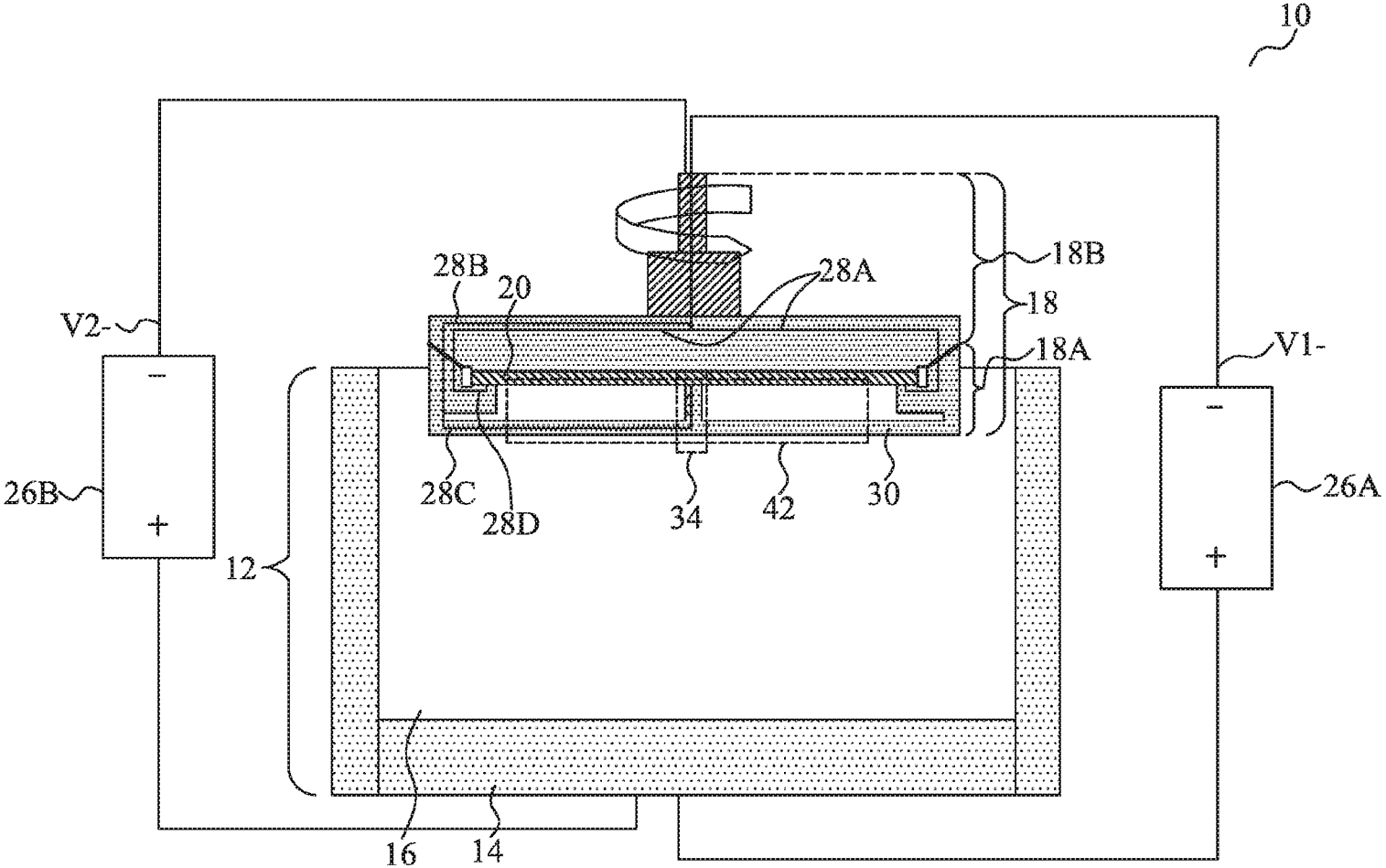
FIG. 8 illustrates a cross-sectional view of an apparatus for performing electro-plating in accordance with alternative embodiments, wherein two power supply sources are used for providing voltages to the wafer.

FIG. 8 illustrates electro-plating apparatus 10 and the plating process in accordance with alternative embodiments. Unless specified otherwise, the materials and formation methods of the components in these embodiments are essentially the same as the like components, which are denoted by like reference numerals in the embodiments shown in FIGS. 1 through 7. The details regarding the formation process and the materials of the components shown in these embodiments may thus be found in the discussion of the embodiment shown in FIGS. 1 through 7. The embodiments in FIG. 8 are similar to the embodiments in FIG. 1, except that the edge portion and the center portion of wafer 20 are connected to different voltage supply sources 26A and 26B, which provide voltages V1− and V2−, respectively. Voltage supply sources 26A and 26B may have different voltages. For example, voltage V1− may be in the range of about 1V to about 10V, and voltage V2− may be in the range of about 5V to about 10V. By making voltages V1− and V2− to be adjustable separately, the plating thickness profile on wafer 20 may be adjusted. Voltage V1− may be greater than, substantially equal to, or lower than, voltage V2− in some embodiments.

Figure 9:
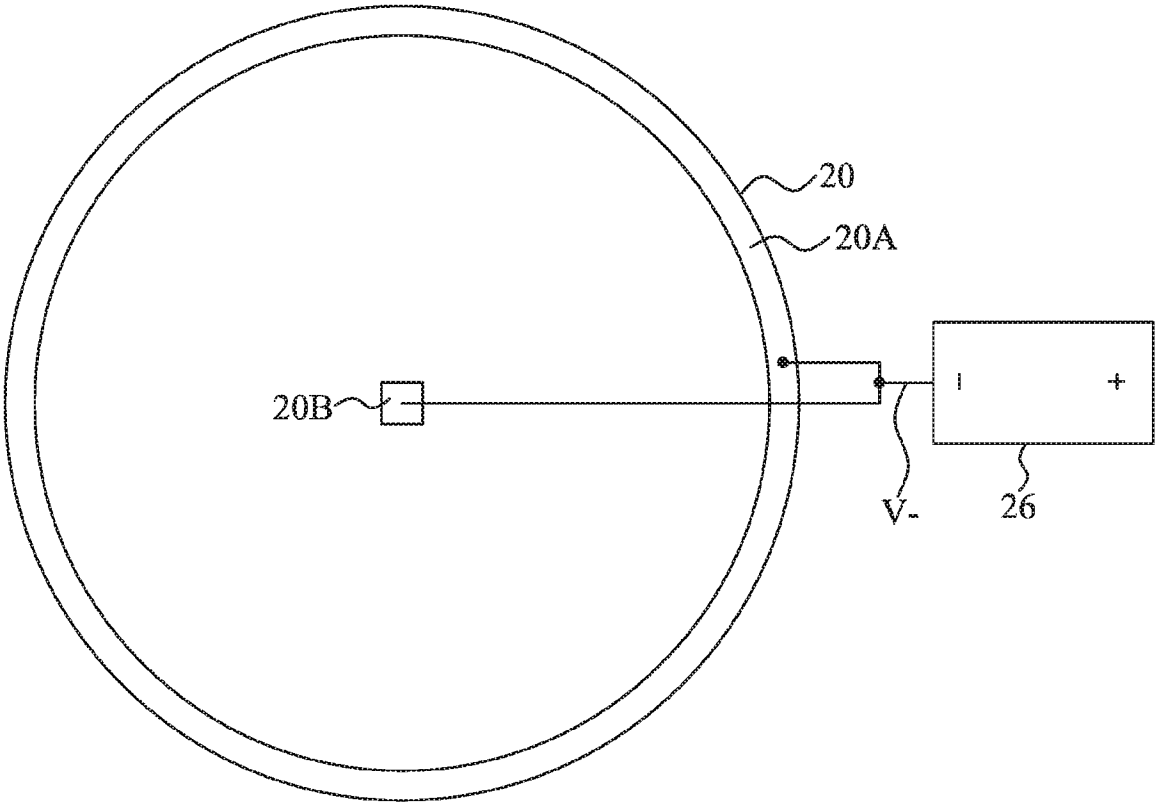
FIGS. 9 through 12 illustrate various exemplary connection schemes for providing voltages to different portions of a wafer.
Figure 10:
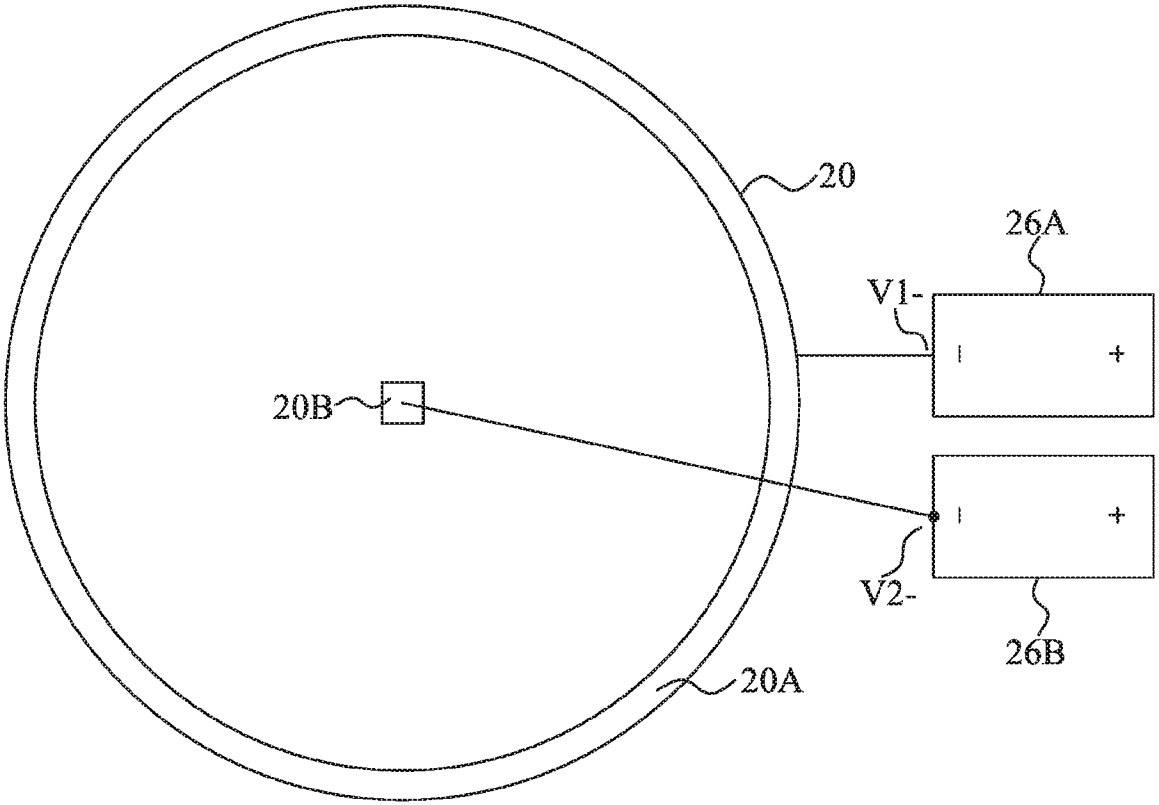

FIGS. 9 through 12 illustrate schemes for applying voltages in accordance with various embodiments. In FIG. 9, edge portion 20A of wafer 20 and center portion 20B of wafer 20 are applied with the same voltage. These embodiments may be achieved using electro-plating apparatus 10 shown in FIG. 1. In FIG. 10, edge portion 20A and center portion 20B are applied with different voltages V1− and V2−, respectively, wherein voltages V1− and V2− are provided by voltage supply sources 26A and 26B, respectively. These embodiments may be achieved using electro-plating apparatus 10 shown in FIG. 8.

Figure 11:
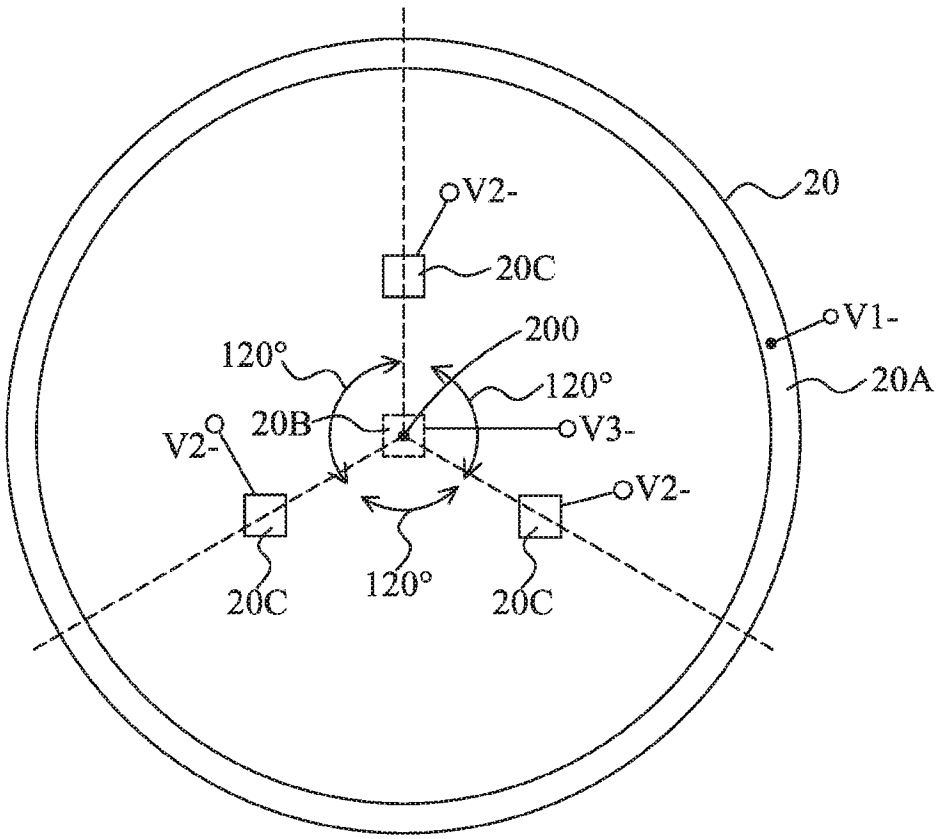

FIG. 11 illustrates the voltage application scheme in accordance with yet another embodiment, wherein wafer portions 20C may be applied with a voltage separately. The voltage applying scheme may be similar to what is shown in FIG. 6, for example. In these embodiments, wafer portions 20C are between center 200 of wafer 20 and edge portion 20A. Wafer portions 20C may be distributed with a rotational symmetric pattern, for example, with the lines connecting wafer portions 20C to the center 200 of wafer 20 forming 120-degree angles. Furthermore, wafer portions 20C may have substantially equal distances from center 200 of wafer 20. In accordance with some embodiments, no additional voltage is applied to wafer center portion 20B. In alternative embodiments, an additional voltage V3− is applied to wafer center portion 20B. Voltages V1−, V2−, and V3−, which are provided to portions, 20A, 20B, and 20C, respectively, may be the same as each other, or may be different from each other.

Figure 12:
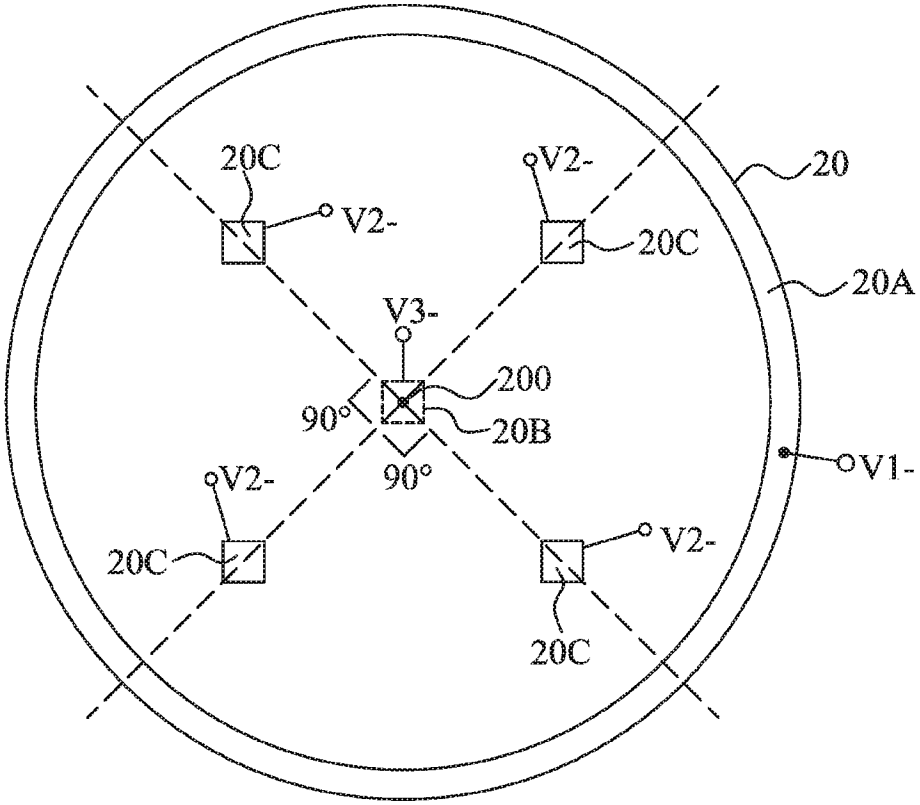

FIG. 12 illustrates the voltage application scheme in accordance with yet alternative embodiments. These embodiments are similar to the embodiments in FIG. 11, except there are four wafer portions 20C applied with voltages V3. In these embodiments, wafer portions 20C may be symmetric, for example, with the lines connecting wafer portions 20C to center 200 of wafer 20 forming 90-degree angles. Furthermore, wafer portions 20C may have substantially equal distances from center 200 of wafer 20. In accordance with some embodiments, no additional voltage is applied to wafer center portion 20B. In alternative embodiments, an additional voltage V3− is applied to wafer center 20B. Voltages V1−, V2−, and V3− may be the same as each other, or may be different from each other.

In the embodiments of the present disclosure, voltages are applied to different portions of the work piece during the plating process. Hence, the uniformity of the thicknesses of the plated metal layer is improved. In addition, a blade may be added for the fluid field control, so that the uniformity of the plating process is further improved. The capability of applying different voltages onto different portions of the work pieces results in the desirable ability for adjusting the profile of the plated metal layer.

In accordance with some embodiments, a method of plating a metal layer on a work piece includes exposing a surface of the work piece to a plating solution, and supplying a first voltage at a negative end of a power supply source to an edge portion of the work piece. A second voltage is supplied to an inner portion of the work piece, wherein the inner portion is closer to a center of the work piece than the edge portion. A positive end of the power supply source is connected to a metal plate, wherein the metal plate and the work piece are spaced apart from each other by, and are in contact with, the plating solution.

In accordance with other embodiments, a method of plating a metal layer on a wafer through electro-plating includes exposing a surface of the wafer to a plating solution, and supplying a first voltage to an edge portion of the wafer. The first voltage is connected through a plurality of electrical contacts that are in contact with the edge portion of the wafer. The plurality of electrical contacts is aligned to a ring adjacent to an edge of the wafer. A second voltage is supplied to a center portion of the wafer. During the plating, the wafer acts as a cathode, and a metal plate acts as an anode, with a metal in the metal plate being plated to the wafer.

In accordance with yet other embodiments, an apparatus is configured to perform electro-plating on a wafer. The apparatus includes a first electrical contact configured to contact an edge portion of the wafer, and a power supply source electrically connected to the first electrical contact. The power supply source is configured to supply a voltage to the edge portion of the wafer. A second electrical contact is configured to contact an inner portion of the wafer, wherein the inner portion of the wafer is encircled by the edge portion of the wafer.

Although the embodiments and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. An apparatus for plating on a wafer, the apparatus comprising:

a work piece holder configured to hold the wafer, the work piece holder comprising a retractable electrode, wherein the retractable electrode comprises:

an outer shell;

a first electrical contact comprising a first portion extending into the outer shell and a second portion extending out of the outer shell, wherein the first electrical contact is configured to be in physical contact with the wafer; and a seal ring encircling the second portion of the first electrical contact, wherein the seal ring is formed of a flexible material, and wherein the seal ring and the first electrical contact are configured to move relative to the outer shell; and a first power supply source electrically connecting to the first electrical contact, wherein the first power supply source is configured to supply a first voltage.

2. The apparatus of claim 1 further comprising:

a second electrical contact configured to be in contact with the wafer; and a second power supply source electrically connecting to the second electrical contact, wherein the second power supply source is configured to supply a second voltage to the second electrical contact, and the second voltage is different from the first voltage.

3. The apparatus of claim 1 further comprising a lip seal having a ring shape, wherein the lip seal is configured to in contact with an edge ring portion of the wafer.

4. The apparatus of claim 1 further comprising an electro-plating container, wherein the outer shell is configured to extend into the electro-plating container.

5. The apparatus of claim 1, wherein the apparatus further comprises a blade configured to be rotated along with the wafer, wherein the blade is a bottom portion of the work piece holder, and is coaxial with the wafer.

6. The apparatus of claim 5, wherein the blade comprises:

a first wing having a first slant surface facing toward the wafer; and a second wing having a second slant surface facing away from the wafer.

7. The apparatus of claim 5 further comprising a conductor in the blade, wherein the conductor electrically connects to the first power supply source to the first electrical contact.

8. An apparatus for plating on a wafer, the apparatus comprising:

a work piece holder configured to fix the wafer thereon, the work piece holder comprising:

a blade configured to rotate along with the wafer, wherein the blade comprises a major slant surface neither perpendicular to nor parallel to a major surface of the wafer;

a retractable electrode connecting to a center of the blade; and a conductive line comprising:

a first portion embedded in the blade; and a second portion embedded in the retractable electrode; and a power source electrically connecting to the conductive line.

9. The apparatus of claim 8, wherein the blade further comprises a vertical surface perpendicular to the major surface of the wafer.

10. The apparatus of claim 8, wherein the blade is configured to rotate along with the wafer.

11. The apparatus of claim 8, wherein the retractable electrode comprises a seal ring formed of a flexible material, and wherein the second portion of the conductive line penetrates through the flexible material.

12. The apparatus of claim 11, wherein the seal ring is configured to seal the second portion of the conductive line from a plating solution used for plating the wafer.

13. The apparatus of claim 8, wherein the retractable electrode is configured to adjust its length in response to adjustment of a distance between the blade and the wafer.

14. An apparatus for plating on a wafer, the apparatus comprising:

a work piece holder configured to fix the wafer thereon, the work piece holder comprising:

a cylinder comprising a seal ring;

an outer shell having a portion of the cylinder therein, wherein a length of a part of the cylinder out of the outer shell is adjustable;

a blade connected to the outer shell, wherein the blade comprises:

a vertical surface perpendicular to a major surface of the wafer; and a major slant surface neither perpendicular to nor parallel to the vertical surface; and a conductive line comprising:

a first portion penetrating through the seal ring;

a second portion in the outer shell; and a third portion embedded in the blade; and a voltage supply source connecting to the conductive line.

15. The apparatus of claim 14, wherein the blade is configured to rotate along with the cylinder.

16. The apparatus of claim 14, wherein the blade is configured to rotate along with the outer shell.

17. The apparatus of claim 14, wherein the seal ring is formed of a flexible material configured to isolate the first portion of the conductive line from a plating solution outside of the seal ring.

18. The apparatus of claim 17, wherein the seal ring comprises rubber.

19. The apparatus of claim 8 further comprising an electro-plating solution container, wherein the work piece holder is configured to be able to partially extend into the electro-plating solution container.

20. The apparatus of claim 14 further comprising an electro-plating solution container, wherein the work piece holder is configured to be able to partially extend into the electro-plating solution container.

* * * * *